US010436557B2

(12) United States Patent
Stakes

(10) Patent No.: US 10,436,557 B2
(45) Date of Patent: Oct. 8, 2019

(54) ARMOR-PIERCING PROJECTILE

(71) Applicant: Michael A. Stakes, New River, AZ (US)

(72) Inventor: Michael A. Stakes, New River, AZ (US)

(73) Assignee: AMMO TECHNOLOGIES, INC., Scottsdale, AZ (US)

( * ) Notice: Subject to any disclaimer, the term of this patent is extended or adjusted under 35 U.S.C. 154(b) by 0 days.

(21) Appl. No.: 15/131,319

(22) Filed: Apr. 18, 2016

(65) Prior Publication Data

US 2017/0299356 A1 Oct. 19, 2017

(51) Int. Cl.

| | |
|---|---|
| ***F42B 12/04*** | (2006.01) |
| ***F42B 12/44*** | (2006.01) |
| ***F42B 12/74*** | (2006.01) |
| ***F42B 12/78*** | (2006.01) |
| ***F42B 12/06*** | (2006.01) |

(52) U.S. Cl.

CPC ..... *F42B 12/04* (2013.01); *F42B 12/06* (2013.01); *F42B 12/44* (2013.01); *F42B 12/74* (2013.01); *F42B 12/78* (2013.01)

(58) Field of Classification Search

CPC ..... F42B 12/00; F42B 12/02; F42B 12/04; F42B 12/06; F42B 12/08; F42B 12/16; F42B 12/44; F42B 8/12; F42B 10/42; F42B 10/38; F42B 10/40; F42B 10/44; F42B 10/46

See application file for complete search history.

(56) References Cited

U.S. PATENT DOCUMENTS 287,924 A * 11/1883 Gruson et al. ..... F42B 12/204 102/477
446,975 A * 2/1891 Moore ..... F42B 12/44 102/365
740,914 A * 10/1903 Platz ..... F42B 12/06 102/519
804,380 A * 11/1905 Chronic ..... F42B 12/44 102/365
1,102,758 A * 7/1914 Keen ..... F42B 12/06 102/519
1,132,453 A * 3/1915 Davis ..... F42B 12/06 102/519
1,251,960 A * 1/1918 Buckingham ..... F42B 12/38 102/513

(Continued)

*Primary Examiner* — Derrick R Morgan

(74) *Attorney, Agent, or Firm* — Michael W. Goltry; Robert A. Parson; Parsons & Goltry, PLLC

(57) ABSTRACT

A projectile for piercing armor includes an outer jacket built around a penetrator assembly. The penetrator assembly includes an inner jacket, a penetrator, and an incendiary charge. The inner jacket includes a leading part and a trailing part. The incendiary charge is carried by the leading part of the inner jacket. The penetrator is made of an armor-piercing material and includes an armor-piercing leading extremity, a trailing extremity, and an outer surface. The armor-piercing leading extremity extends into the trailing part of the inner jacket, and the inner jacket bears against the outer surface of the penetrator between the armor-piercing leading extremity and the trailing extremity. An empty space within the inner jacket is between the armor-piercing leading extremity of the penetrator and the incendiary charge.

20 Claims, 1 Drawing Sheet

(56) References Cited

U.S. PATENT DOCUMENTS 1,333,834 A * 3/1920 Clay ..... F42B 12/38 102/364
1,434,681 A * 11/1922 Clay ..... F42B 12/44 102/364
2,322,751 A * 6/1943 Studler ..... F42B 12/06 102/516
2,390,552 A * 12/1945 Nelson ..... F42B 12/204 102/222
2,402,018 A * 6/1946 Burdett ..... F42B 12/44 86/23
2,425,418 A * 8/1947 Burdett ..... F42B 12/204 102/499
2,682,224 A * 6/1954 Braverman ..... F42B 12/34 102/507
2,683,416 A * 7/1954 Keller ..... F42B 12/06 102/513
2,724,334 A * 11/1955 Norton ..... F42B 12/06 102/518
2,792,618 A * 5/1957 Walker ..... F42B 12/08 102/507
2,900,914 A * 8/1959 Ciccone ..... F42B 12/44 102/364
2,932,253 A * 4/1960 Auxier ..... F42B 12/78 102/507
2,958,287 A * 11/1960 Auxier ..... F42B 12/78 102/507
2,975,710 A * 3/1961 Read ..... F42B 12/06 102/364
3,003,420 A * 10/1961 Nosler ..... F42B 12/34 102/508
3,013,495 A * 12/1961 Stevenson ..... F42B 12/38 102/513
3,028,808 A * 4/1962 Porter ..... F42B 12/06 102/364
3,069,748 A * 12/1962 Nosler ..... B21K 1/025 86/55
3,370,535 A * 2/1968 Permutter ..... F42B 12/06 102/518
3,498,222 A * 3/1970 Birkigt ..... F42B 12/06 102/518
3,720,169 A * 3/1973 Johnson ..... F42B 10/08 102/364
3,756,158 A * 9/1973 Anderson ..... F42B 12/78 102/507
3,782,287 A * 1/1974 Sie ..... F42B 12/78 102/516
3,877,380 A * 4/1975 Riparbelli ..... F42B 12/06 102/519
3,948,180 A * 4/1976 Silvia ..... F42B 12/06 102/519
3,981,243 A * 9/1976 Doris, Jr. ..... F42B 12/06 102/364
4,108,072 A * 8/1978 Trinks ..... F42B 12/06 102/518
4,112,846 A * 9/1978 Gilbert ..... F42B 12/06 102/364
4,353,302 A * 10/1982 Strandli ..... F42B 12/06 102/364
4,353,305 A * 10/1982 Moreau ..... F42B 12/34 102/519
4,437,409 A * 3/1984 Freymond ..... F42B 12/06 102/364
4,444,112 A * 4/1984 Strandli ..... F42B 12/06 102/364
4,662,280 A * 5/1987 Becker ..... F42B 12/204 102/364
4,671,180 A * 6/1987 Wallow ..... F42B 12/06 102/517
4,753,172 A * 6/1988 Katzmann ..... F42B 12/06 102/491
4,882,996 A * 11/1989 Bock ..... F42B 12/32 102/496
4,967,666 A * 11/1990 Kellner ..... F42B 12/16 102/476
5,009,166 A * 4/1991 Bilsbury ..... F42B 12/78 102/516
5,020,439 A * 6/1991 Winter ..... F42B 12/204 102/473
5,069,139 A * 12/1991 Denis ..... F42B 12/78 102/511
5,105,514 A * 4/1992 Bilsbury ..... F42B 12/78 86/55
5,164,533 A * 11/1992 Schluckebier ..... F42B 12/204 102/364
5,347,907 A * 9/1994 Strandli ..... F42B 12/06 102/518
5,400,716 A * 3/1995 Mayer ..... F42B 12/78 102/507
5,404,815 A * 4/1995 Reed ..... F42B 12/34 102/507
5,501,153 A * 3/1996 Cassagne ..... F42B 12/36 102/307
5,652,408 A * 7/1997 Nicolas ..... F42B 12/204 102/364
6,016,754 A * 1/2000 Enlow ..... F42B 12/74 102/501
6,119,600 A * 9/2000 Burri ..... F42B 12/78 102/364
6,209,459 B1 * 4/2001 Kaufman ..... F42B 5/025 102/439
6,286,433 B1 * 9/2001 Borg ..... F42B 12/06 102/516
6,317,946 B1 * 11/2001 Beal ..... F42B 12/74 102/516
6,374,743 B1 * 4/2002 Hug ..... F42B 12/74 102/514
6,799,519 B2 * 10/2004 Meyer ..... F42B 14/064 102/439
6,845,719 B1 * 1/2005 Spencer ..... F42B 12/08 102/519
7,150,233 B1 * 12/2006 Eberhart ..... F42B 12/74 102/516
7,603,951 B2 * 10/2009 Rose ..... F42B 12/06 102/364
7,980,180 B2 * 7/2011 MacDougall ..... F42B 12/06 102/514
9,562,753 B2 * 2/2017 Stock, Jr. ..... F42B 12/34
9,587,918 B1 * 3/2017 Burrow ..... F42B 5/02
9,702,678 B1 * 7/2017 Moretti ..... F42B 12/44
9,797,695 B2 * 10/2017 Gelfert ..... F42B 5/067
10,082,376 B1 * 9/2018 Thomas ..... F42B 33/00
2003/0167956 A1 * 9/2003 Kellner ..... F42B 12/204 102/517
2006/0011086 A1 * 1/2006 Rose ..... F42B 12/06 102/364
2007/0017409 A1 * 1/2007 Mansfield ..... F42B 12/06 102/518
2007/0204758 A1 * 9/2007 Spatz ..... F42B 12/34 102/514
2008/0035007 A1 * 2/2008 Nielson ..... C06B 45/00 102/517
2009/0293754 A1 * 12/2009 Riess ..... F42B 12/34 102/506
2010/0224093 A1 * 9/2010 Wilhelm ..... F42B 12/34 102/507
2010/0263565 A1 * 10/2010 Hugus, IV ..... F42B 12/44 102/364
2015/0308802 A1 * 10/2015 Chua ..... F42B 12/382 102/513
2016/0153757 A1 * 6/2016 Mahnke ..... F42B 10/22 102/501
2016/0252332 A1 * 9/2016 Gelfert ..... F42B 5/067 102/464
2016/0282097 A1 * 9/2016 Henry, III ..... F42B 33/00
2017/0297112 A9 * 10/2017 Burrow ..... C22C 38/58

(56) References Cited

U.S. PATENT DOCUMENTS

2017/0322002 A1* 11/2017 Mahnke ..... F42B 10/22
2017/0336183 A1* 11/2017 Muster ..... F42B 8/14

* cited by examiner

ARMOR-PIERCING PROJECTILE

FIELD OF THE INVENTION

The present invention relates to armor-piercing projectiles.

BACKGROUND OF THE INVENTION

An armor-piercing projectile is a type of ammunition designed to penetrate armor. Artillery projectiles are used to defeat heavily armored targets, such as tanks, bunkers, and armored warships. Projectiles smaller than 20 mm in size that are fired from handheld or small arms weapons, including revolvers, pistols, rifles, carbines, assault rifles, submachine guns, and light machine guns, are used to defeat lightly-armored targets, such as body armor and bulletproof glass.

The prior art is replete with armor-piercing projectiles, particularly armor-piercing projectiles designed to be fired from small arms weapons. Improvements in body armor and light-vehicle armor have driven the innovation in armor-piercing projectiles. Although the prior art provides a variety of armor-piercing projectiles designed to be fired from small arms weapons, these projectiles have structural and functional shortcomings necessitating new and useful improvements.

Of particular significance is the high-explosive incendiary/armor-piercing ammunition (HEIAP), which is a form of shell which combines armor-piercing capability and a high-explosive component. HEIAP munitions use high explosives to "blast a path" for the penetrator. The special effect is developed when the round strikes the target. The initial collision ignites the incendiary charge in the tip, triggering the detonation of the incendiary charge. A second incendiary charge immediately behind the incendiary charge, typically zirconium powder, also ignites. However, the second incendiary charge burns at a very high temperature, is not easily extinguished, and can last up to 15 minutes. The remaining element of the round is the penetrator, which is normally constructed of tungsten carbide. The penetrator carries a large amount of kinetic energy, which enables it to penetrate the armor initially weakened by the incendiary charge. However, the leading penetrating extremity of the penetrator is embedded into the secondary incendiary charge. As a result, the secondary incendiary charge inherently interrupts the kinetic energy of the penetrator when the secondary incendiary charge detonates. The loss of kinetic energy in the penetrator can disable the penetrator from fully penetrating the armor, especially sophisticated armor. It would be highly advantageous, therefore, to remedy the foregoing and other deficiencies inherent in the prior art.

SUMMARY OF THE INVENTION

According to the principle of the invention, a projectile for piercing armor includes a penetrator assembly, and an outer jacket or casing. The penetrator assembly includes an inner jacket, an incendiary charge, and a penetrator. The inner jacket includes a leading part and a trailing part. The incendiary charge is carried by the leading part. The penetrator is made of an armor-piercing material and includes an armor-piercing leading extremity, a trailing extremity, and an outer surface. The armor-piercing leading extremity extends into the trailing part of the inner jacket, and the inner jacket bears against the outer surface of the penetrator between the armor-piercing leading extremity and the trailing extremity. There is an empty space within the inner jacket between the armor-piercing leading extremity of the penetrator and the incendiary charge. The outer jacket is hollow and is built around the penetrator assembly. The penetrator assembly is axially centered inside the outer jacket. The penetrator assembly is centered around a longitudinal axis of the outer jacket. The outer jacket includes a ballistic nose ahead of the inner jacket and the incendiary charge. The ballistic nose is of solid construction and has a trailing nose surface in direct contact against a leading surface of the incendiary charge. The armor-piercing leading extremity of the penetrator includes a conical tip. The penetrator further includes a cylindrical main part, and a peripheral edge between the conical tip and the cylindrical main part. The cylindrical main part extends from the peripheral edge to the trailing extremity, which is frusto-conical in shape. The trailing part of the inner jacket bears against the outer surface of the cylindrical main part of the penetrator proximate to the peripheral edge. The inner jacket is made of a material selected from a group of stainless steel and aluminum. The incendiary charge is non-explosive, and is a non-explosive incendiary mixture or composition. In an illustrative embodiment, the incendiary charge is thermite, which is an inherently non-explosive incendiary mixture or composition. The armor-piercing material is selected from a group of hardened steel, tungsten, tungsten carbide, and depleted uranium. The outer jacket is made of a material selected from a group of copper, cupronickel, tombac, and tombac-plated steel.

According to the principle of the invention, a projectile for piercing armor includes a penetrator assembly, and an outer jacket or casing. The penetrator assembly includes an inner jacket, an incendiary charge, and a penetrator. The inner jacket includes a continuous sidewall having a leading edge, a trailing edge, an outer surface, and an inner surface, and a dividing wall. The dividing wall is affixed to the inner surface of the continuous sidewall between the leading edge and the trailing edge. The dividing wall cooperates with the inner surface of the continuous sidewall to form a leading volume between the leading edge and the dividing wall and a trailing volume between the trailing edge and the dividing wall. The leading edge encircles a leading opening to the leading volume, and the trailing edge encircles a trailing opening to the trailing volume. The incendiary charge in the leading volume, the incendiary charge extends from the dividing wall to a leading surface of the incendiary charge proximate to the leading opening to the leading volume. The penetrator is made of an armor-piercing material and includes an armor-piercing leading extremity, a trailing extremity, and an outer surface. The armor-piercing leading extremity extends into the trailing volume of the inner jacket through the trailing opening, and the inner surface of the continuous sidewall of the inner jacket proximate to the trailing edge bears against the outer surface of the penetrator between the leading extremity and the trailing extremity. There is an empty space in the trailing volume of the inner jacket between the armor-piercing leading extremity of the penetrator and the dividing wall. The outer jacket is hollow and is built around the penetrator assembly. The penetrator assembly is axially centered inside the outer jacket. The penetrator assembly is centered around a longitudinal axis of the outer jacket. The outer jacket includes a ballistic nose ahead of the leading edge of the inner jacket and the leading surface of the incendiary charge. The ballistic nose is of solid construction and has a trailing nose surface in direct contact against the leading edge of the inner jacket and leading surface of the incendiary charge. The armor-piercing leading extremity of the penetrator includes a conical tip. The penetrator further includes a cylindrical main part, and a peripheral edge between the conical tip and the cylindrical main part. The cylindrical main part extends from the peripheral edge to the trailing extremity, which is frustoconical in shape. The inner surface of the continuous sidewall proximate to the trailing edge bears against the outer surface of the cylindrical main part of the penetrator proximate to the peripheral edge. The inner jacket is made of a material selected from a group of stainless steel and aluminum. The incendiary charge is non-explosive, and is a non-explosive incendiary mixture or composition. In an illustrative embodiment, the incendiary charge is thermite, which is an inherently non-explosive incendiary mixture or composition. The armor-piercing material is selected from a group of hardened steel, tungsten, tungsten carbide, and depleted uranium. The outer jacket is made of a material selected from a group of copper, cupronickel, tombac, and tombac-plated steel.

BRIEF DESCRIPTION OF THE DRAWINGS

Referring to the drawings.

DETAILED DESCRIPTION

Figure 1:
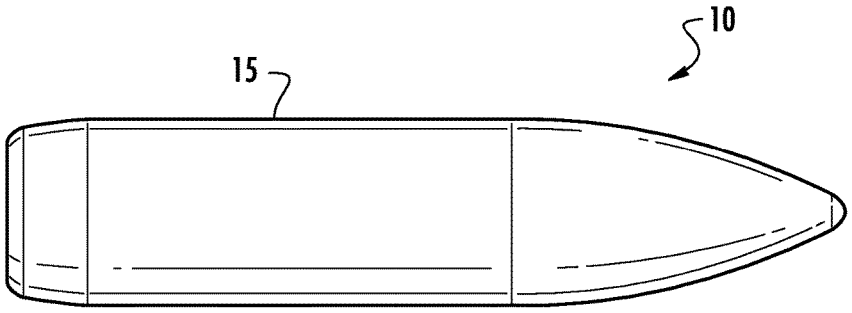
FIG. 1 is a side elevation view of a projectile for piercing armor, the projectile being constructed and arranged in accordance with the principle of the invention.

Turning now to the drawings, in which like reference characters indicate corresponding elements throughout the several views, attention is first directed to FIG. 1 in which there is seen a projectile 10 for piercing armor. Projectile 10 includes a penetrator assembly 12 and a hollow outer jacket or casing 15. Penetrator assembly 12 is axially centered inside outer jacket or casing 15.

Figure 2:
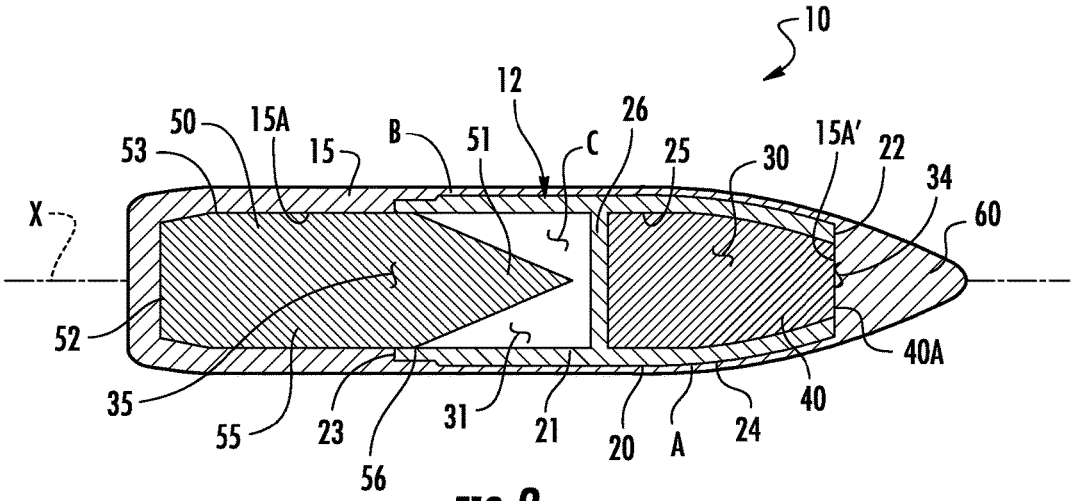
FIG. 2 is a longitudinal section view of the projectile of FIG. 1.

Referring to FIG. 2, penetrator assembly 12 includes inner jacket 20, incendiary charge 40, and penetrator 50. Inner jacket 20 is made of a material or combination of materials having inherently good strength and mobility material characteristics, such as stainless steel, and aluminum. Inner jacket 20 includes continuous sidewall 21 having leading edge 22, trailing edge 23, outer surface 24, inner surface 25, and dividing wall 26. Outer surface 24 and inner surface 25 each extend from leading edge 22 to trailing edge 23. Dividing wall 26 is affixed to the inner surface 25 of continuous sidewall 21 between leading edge 22 and trailing edge 23. Dividing wall 26 cooperates with inner surface 25 of continuous sidewall 21 to form leading volume 30 of inner jacket 20 between leading edge 22 and dividing wall 26, and trailing volume 31 of inner jacket 20 between trailing edge 23 and dividing wall 26. Leading edge 22 encircles leading opening 34 to leading volume 30. Trailing edge 23 encircles trailing opening 35 to trailing volume 31. Dividing wall 26 is parallel with respect to leading opening 34 and trailing opening 35. The portion of inner jacket 20 from dividing wall 26 to leading edge 22 is a leading part A of inner jacket 20. The portion of inner jacket 20 from dividing wall 26 to trailing edge 22 is a trailing part B of inner jacket 20. Leading volume 30 is formed in leading part A of inner jacket 20. Trailing volume 31 is formed in trailing part B of inner jacket 20.

Incendiary charge 40 is non-explosive, and is a non-explosive incendiary mixture or composition, according to the principle of the invention. In an illustrative embodiment, incendiary charge 40 is thermite, which is an inherently non-explosive incendiary mixture or composition. Thermite is a known mixture of finely-divided metallic particles and metal oxide that when ignited produces extremely high temperatures as the result of the union of the aluminum with the oxygen of the oxide. Iron thermite or copper thermite are useful incendiary mixtures/compositions for incendiary charge 40 in illustrative embodiments.

Leading part A of inner jacket 20 is packed with incendiary charge 40. Leading part A holds incendiary charge 40. Specifically, incendiary charge 40 is applied to, and fills, leading volume 30 of leading part A of inner jacket 20. Incendiary charge 40 completely fills leading volume 30. Incendiary charge 40 is packed against dividing wall 26 and inner surface 25 that defines leading volume 30, and extends through leading volume 30 from dividing wall 26 to a leading surface 40A of incendiary charge 40 proximate to leading edge 22 and proximate to leading opening 34 to leading volume 30. Leading surface 40A of incendiary charge 40 is coplanar with leading opening 34 to leading volume 30 packed with incendiary charge 40. Dividing wall 26 isolates leading volume 30 from trailing volume 31, and isolates incendiary charge 40 in leading volume 30 from trailing volume 31, according to the invention.

Penetrator 50 is a pointed mass of an armor piercing material, a high-density material, such as hardened steel, tungsten, tungsten carbide, or depleted uranium, which is designed to retain its shape and carry the maximum possible amount of energy as deeply as possible into a target. Penetrator 50 includes armor-piercing leading extremity 51, trailing extremity 52, and outer surface 53. Leading extremity 51 is pointed, being a conical tip. Penetrator 50 further includes a cylindrical main part 55, and a peripheral edge 56 between conical tip defining leading extremity 51 and cylindrical main part 55. Cylindrical main part 55 extends from peripheral edge 56 to trailing extremity 52, which is frustoconical in shape.

Leading extremity 51, the conical tip of penetrator 50, extends into trailing part B and, more specifically, into trailing volume 31 of inner jacket 20 through trailing opening 35. Inner surface 25 of continuous sidewall 21 of inner jacket 20 proximate to trailing edge 23 bears against outer surface 53 of penetrator 50 between leading extremity 51 and trailing extremity 52, which holds penetrator 50 to inner jacket 20, according to the invention. More specifically, inner surface 25 of continuous sidewall 21 proximate to trailing edge 23 of inner jacket 20 bears against outer surface 53 of cylindrical main part 55 of penetrator 50 proximate to peripheral edge 56 which, again, holds penetrator 50 to inner jacket 20, according to the invention. There is an empty space denoted at C in trailing volume 31 of inner jacket 20 between leading extremity 51, the conical tip of penetrator 50 extending forwardly from peripheral edge 56, and dividing wall 26. Again, dividing wall 26 isolates leading volume 30 from trailing volume 31, and isolates incendiary charge 40 in leading volume 30 from trailing volume 31 and from leading extremity 51 of penetrator 50 in trailing volume 31 of trailing part B of inner jacket 20.

Outer jacket 15 is made of copper, cupronickel, tombac, tombac-plated steel, or the like, as is customary in the art. Outer jacket 15 is hollow, and is built around penetrator assembly 12. Penetrator assembly 12 is axially centered inside outer jacket 15. Penetrator assembly 12 is centered around a longitudinal axis X of outer jacket 15, which extends centrally through penetrator 50 from trailing extremity 52 to leading extremity centrally through inner jacket 20 from trailing opening 35 and through incendiary charge 40 to leading opening 34. Outer jacket 15 is formed directly and tightly against penetrator assembly 12 and holds penetrator assembly 12, such that inner surface 15A of outer jacket 15 is contoured to and bears against outer surface 53 of penetrator from trailing extremity 52 to trailing edge 23 of inner jacket 20, and against trailing edge 23 along outer surface 24 of inner jacket 20 to leading edge 22, and against leading edge 22 and leading surface 40A of incendiary charge 40. Penetrator assembly 12 is thus encapsulated in, and held firmly by, outer jacket 15. Outer jacket 15 includes a nose 60 ahead of leading edge 22 of inner jacket 20 and leading surface 40A of incendiary charge 40. Nose 60 is a ballistic nose. Nose 60 is of solid construction in this embodiment, and has inner or trailing nose surface 15A' of the inner surface 15A of outer jacket 15 in direct contact against the leading edge 22 of inner jacket 20 and leading surface 40A of incendiary charge 40, and tapers conically forward from trailing nose surface 15A' in contact against leading edge 22 of inner jacket 20 and leading surface 40A of incendiary charge 40.

Outer jacket 15 has an outer shape. The outer shape of projectile 10 is defined entirely by the outer shape of outer jacket 15, which has conical ballistic nose 60 at the leading end of projectile 10. The rear part of outer jacket 15 at the trailing end of projectile 10 that is formed over trailing extremity 52 of penetrator 50 is angled in to form a so-called boat tail.

In this example, projectile 10 is a small arms projectile, in that it is a caliber that is smaller than 20 mm in size, is fired from a handheld or small arms weapons, such as a revolver, a pistol, a rifle, a carbine, an assault rifle, a submachine gun, or a light machine gun, and is intended to be used to defeat lightly-armored targets, such as body armor and bulletproof glass. Projectile 10 leads with nose 60 when fired toward target downrange. The initial collision with the target compresses trailing nose surface 15A' of nose 60 against leading surface 40A of incendiary charge 40, which compresses incendiary charge 40 between trailing nose surface 15A' and dividing wall 26. At the same time, the compression of incendiary charge 40 ignites incendiary charge 40 and nose 60 and outer jacket 15 spall. Incendiary charge 40 ignites into the target. The portion of inner jacket 20 from dividing wall 26 to leading edge 22 of part A initially consolidates and focuses the ignited incendiary charge 40 forwardly into the target through leading opening 34 of leading part A of inner jacket 20, enabling the inherent heat generated by the ignited incendiary charge 40 to burn into the target through leading opening 34 for initially weakening and defeating the target. Dividing wall 26 and space C between dividing wall 26 and leading extremity 51 of penetrator 50, in turn, isolates the ignited incendiary charge 40 from trailing volume 31 and from leading extremity 51 of penetrator 50, disabling the ignited incendiary charge 40 from blow-back against leading extremity 51 of penetrator 50, which prevents the ignited incendiary charge 40 from disrupting the inherent kinetic energy carried by penetrator 50 that could otherwise disable penetrator 50 from maximum target penetration. Moreover, space C enables penetrator 50 to maintain its inherent kinetic energy without interruption by a filling or other structure in space C. Penetrator 50, which, a again, carries a large amount of inherent kinetic energy, advances through space C and into the area of target initially weakened/defeated by incendiary charge 40 ahead of leading extremity 51 of penetrator 50, which enables penetrator 50 to penetrate and defeat the target, according to the principle of the invention.

In this example, projectile 10 is a small arms projectile, in that it is a caliber that is smaller than 20 mm in size and that is fired from a handheld or small arms weapons, such as a revolver, a pistol, a rifle, a carbine, an assault rifle, a submachine gun, or a light machine gun, and that it is intended to be used to defeat lightly-armored targets, such as body armor and bulletproof glass. In alternate embodiments, a projectile constructed and arranged in accordance with the principle of the invention can be constructed in calibers from 20 mm and greater for defeating heavily armored targets, such as tanks, bunkers, and armored warships.

According to this disclosure, projectile 10 for piercing armor includes penetrator assembly 12, and outer jacket or casing 15. Penetrator assembly 12 includes inner jacket 20, incendiary charge 40, and penetrator 50. Inner jacket 20 includes leading part A and trailing part B. Incendiary charge 40 is carried by leading part A of inner jacket 20, which is a carrier or support. Penetrator 50 is made of an armor-piercing material and includes armor-piercing leading extremity 51, trailing extremity 51, and outer surface 53. Leading extremity 51 extends into trailing part B of inner jacket 20, and inner jacket 20 bears against outer surface 53 of penetrator 50 between leading extremity 51 and trailing extremity 52. There is empty space C within inner jacket 20 between leading extremity 51 of penetrator 50 and incendiary charge 40. Outer jacket 20 is hollow and is built around and holds penetrator assembly 12. Penetrator assembly 12 is axially centered inside outer jacket 15. Penetrator assembly 12 is centered around longitudinal axis X of outer jacket 15. Outer jacket 15 includes ballistic nose 60 ahead of inner jacket 20 and incendiary charge 40. Nose 60 is of solid construction and has trailing nose surface 15A' in direct contact against leading surface 40A of incendiary charge 40. Leading extremity 51 of penetrator 50 includes a conical tip. Penetrator 50 further includes cylindrical main part 55, and peripheral edge 56 between the conical tip of leading extremity 51 and cylindrical main part 55. Cylindrical main part 55 extends from peripheral edge 56 to trailing extremity 52 of penetrator 50, which is frustoconical in shape. Trailing part B of inner jacket 20 bears against outer surface 53 of cylindrical main part 55 of penetrator 50 proximate to peripheral edge 56. Inner jacket 20 is made of a material selected from a group of stainless steel and aluminum, incendiary charge 40 is non-explosive and is made of a non-explosive incendiary mixture or composition, which is thermite in an illustrative embodiment, the armor-piercing material of penetrator 50 is selected from a group of hardened steel, tungsten, tungsten carbide, and depleted uranium, and outer jacket 15 is made of a material selected from a group of copper, cupronickel, tombac, and tombac-plated steel.

According to this disclosure in another aspect of the invention, projectile 10 for piercing armor includes penetrator assembly 12, and outer jacket or casing 15. Penetrator assembly 12 includes inner jacket 20, incendiary charge 40, and penetrator 50. In this embodiment, inner jacket 20, a carrier or support, includes continuous sidewall 21 having leading edge 22, trailing edge 23, outer surface 24, and inner surface 25, and dividing wall 26. Dividing wall 26 is affixed to inner surface 25 of continuous sidewall 21 between leading edge 22 and trailing edge 23. Dividing wall 26 cooperates with inner surface 25 of continuous sidewall 21 to form leading volume 40 between leading edge 22 and dividing wall 26, and trailing volume 31 between trailing edge 23 and dividing wall 26. Leading edge 22 encircles leading opening 34 to leading volume 30. Trailing edge 23 encircles trailing opening 35 to trailing volume 31. Incendiary charge 40 is in leading volume 30. Incendiary charge 40 fills leading volume 30, and extends from dividing wall 26 to leading surface 40A of incendiary charge 40 proximate to leading opening 34 to leading volume 30. Penetrator 50 is made of an armor-piercing material and includes armor-piercing leading extremity 51, trailing extremity 52, and outer surface 53. Leading extremity 51 extends into trailing volume 31 of inner jacket 20 through trailing opening 35, and inner surface 25 of continuous sidewall 21 of inner jacket 20 proximate to trailing edge 23 bears against outer surface 53 of penetrator 50 between leading extremity 51 and trailing extremity 52. There is empty space C in trailing volume 31 of inner jacket 20 between leading extremity 51 of penetrator 50 and dividing wall 26. Outer jacket 15 is hollow and is built around and holds penetrator assembly 12. Penetrator assembly 12 is axially centered inside outer jacket 15. Penetrator assembly 12 is centered around longitudinal axis X of outer jacket 15. Outer jacket 15 includes nose 60 ahead of leading edge 22 of inner jacket 20 and leading surface 40A of incendiary charge 40. Nose 60, which is a ballistic nose, is of solid construction and has trailing nose surface 15A' in direct contact against leading edge 22 of inner jacket 20 and leading surface 40A of incendiary charge 40. Leading extremity 51 of penetrator 50 includes a conical tip. Penetrator 50 further includes cylindrical main part 55, and peripheral edge 56 between the conical tip of leading extremity 51 and cylindrical main part 55. Cylindrical main part 55 extends from peripheral edge 56 to trailing extremity 52, which is frustoconical in shape. Inner surface 25 of continuous sidewall 21 proximate to trailing edge 23 bears against outer surface 15 of cylindrical main part 55 of penetrator 50 proximate to peripheral edge 56. Inner jacket 20 is made of a material selected from a group of stainless steel and aluminum, incendiary charge 40 is non-explosive and is made of a non-explosive incendiary mixture or composition, which is thermite in an illustrative embodiment, the armor-piercing material of penetrator 50 is selected from a group of hardened steel, tungsten, tungsten carbide, and depleted uranium, and outer jacket 15 is made of a material selected from a group of copper, cupronickel, tombac, and tombac-plated steel.

The invention has been described above with reference to illustrative embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A projectile, comprising:

a penetrator and an incendiary charge inside an outer jacket;

the penetrator includes a peripheral edge, a trailing extremity, a cylindrical main part between the peripheral edge and the trailing extremity, and a pointed armor-piercing leading extremity extending conically forwardly from the peripheral edge;

the incendiary charge is ahead of the penetrator and includes a leading surface;

the outer jacket includes a ballistic nose ahead of the incendiary charge;

the ballistic nose has a trailing nose surface in direct contact against the leading surface of the incendiary charge; and the penetrator is behind, and is not in contact with, the incendiary charge, the cylindrical main part extends forwardly from the trailing extremity to the peripheral edge, the pointed armor-piercing leading extremity extending conically forwardly from the peripheral edge resides uncontacted within an empty space inside the outer jacket between and separating the pointed armor-piercing leading extremity and the incendiary charge, the empty space extends forwardly from the peripheral edge of the penetrator, and an inner surface of the outer jacket bears against an outer surface of the cylindrical main part thereby holding the penetrator to the outer jacket.

2. The projectile according to claim 1, wherein the penetrator and the incendiary charge are centered about a longitudinal axis of the outer jacket.

3. The projectile according to claim 1, wherein the outer jacket is made of a material selected from a group of copper, cupronickel, tombac, and tombac-plated steel.

4. The projectile according to claim 1, wherein the penetrator is made of an armor-piercing material.

5. The projectile according to claim 4, wherein the armor-piercing material is selected from a group of hardened steel, tungsten, tungsten carbide, and depleted uranium.

6. The projectile according to claim 1, wherein the incendiary charge is a non-explosive incendiary composition.

7. The projectile according to claim 1, wherein the incendiary charge is carried by an inner jacket inside the outer jacket.

8. The projectile according to claim 7, wherein the inner jacket defines a leading volume and a leading edge encircling a leading opening to the leading volume, the incendiary charge is in the leading volume, and the leading surface of the incendiary charge is proximate to the leading opening to the leading volume.

9. The projectile according to claim 8, wherein the trailing nose surface is in direct contact against the leading edge of the inner jacket.

10. The projectile according to claim 8, wherein the inner jacket is made of a material selected from a group of stainless steel and aluminum.

11. A projectile, comprising:

a penetrator and an incendiary charge inside an outer jacket;

the penetrator includes a peripheral edge, a trailing extremity, a cylindrical main part between the peripheral edge and the trailing extremity, and a pointed armor-piercing leading extremity extending conically forwardly from the peripheral edge;

the incendiary charge is ahead of the penetrator and includes a leading surface;

the outer jacket includes a ballistic nose ahead of the incendiary charge;

the ballistic nose is of solid construction and has a trailing nose surface in direct contact against the leading surface of the incendiary charge;

the penetrator is behind, and is not in contact with, the incendiary charge, the cylindrical main part extends forwardly from the trailing extremity to the peripheral edge, the pointed armor-piercing leading extremity extending conically forwardly from the peripheral edge resides uncontacted within an empty space inside the outer jacket between and separating the pointed armor-piercing leading extremity and the incendiary charge, the empty space extends forwardly from the peripheral edge of the penetrator, and an inner surface of the outer jacket bears against an outer surface of the cylindrical main part thereby holding the penetrator to the outer jacket.

12. The projectile according to claim 11, wherein the penetrator and the incendiary charge are centered about a longitudinal axis of the outer jacket.

13. The projectile according to claim 11, wherein the outer jacket is made of a material selected from a group of copper, cupronickel, tombac, and tombac-plated steel.

14. The projectile according to claim 11, wherein the penetrator is made of an armor-piercing material.

15. The projectile according to claim 14, wherein the armor-piercing material is selected from a group of hardened steel, tungsten, tungsten carbide, and depleted uranium.

16. The projectile according to claim 11, wherein the incendiary charge is a non-explosive incendiary composition.

17. The projectile according to claim 11, wherein the incendiary charge is carried by an inner jacket inside the outer jacket.

18. The projectile according to claim 17, wherein the inner jacket defines a leading volume and a leading edge encircling a leading opening to the leading volume, the incendiary charge is in the leading volume, and the leading surface of the incendiary charge is proximate to the leading opening to the leading volume.

19. The projectile according to claim 18, wherein the trailing nose surface is in direct contact against the leading edge of the inner jacket.

20. The projectile according to claim 17, wherein the inner jacket is made of a material selected from a group of stainless steel and aluminum.

* * * * *